US010192659B2

(12) United States Patent
Akahane et al.

(10) Patent No.: US 10,192,659 B2
(45) Date of Patent: Jan. 29, 2019

(54) CHIP RESISTOR

(71) Applicant: KOA Corporation, Ina-shi, Nagano (JP)

(72) Inventors: Yasushi Akahane, Ina (JP); Shinsuke Chihara, Ina (JP)

(73) Assignee: KOA Corporation, Ina-shi (JP)

( * ) Notice: Subject to any disclaimer, the term of this patent is extended or adjusted under 35 U.S.C. 154(b) by 0 days.

(21) Appl. No.: 15/572,847

(22) PCT Filed: Apr. 11, 2016

(86) PCT No.: PCT/JP2016/061699
§ 371 (c)(1),
(2) Date: Nov. 9, 2017

(87) PCT Pub. No.: WO2016/181737
PCT Pub. Date: Nov. 17, 2016

(65) Prior Publication Data

US 2018/0158578 A1 Jun. 7, 2018

(30) Foreign Application Priority Data

May 11, 2015 (JP) ..... 2015-096580

(51) Int. Cl.
*H01C 1/148* (2006.01)
*H01C 7/00* (2006.01)
*H01C 1/142* (2006.01)

(52) U.S. Cl.
CPC ..... *H01C 1/148* (2013.01); *H01C 1/142* (2013.01); *H01C 7/00* (2013.01)

(58) Field of Classification Search
CPC ..... H01C 1/142; H01C 1/148; H01C 7/00
(Continued)

(56) References Cited

U.S. PATENT DOCUMENTS 7,782,173 B2 * 8/2010 Urano ..... H01C 1/012 338/307
2007/0296542 A1 * 12/2007 Kuriyama ..... H01C 1/148 338/258

FOREIGN PATENT DOCUMENTS

JP 1-109702 A 4/1989
JP 9-180957 A 7/1997
(Continued)

OTHER PUBLICATIONS

Kaji et al., JP 09-180957, Jul. 1997. Machine translation.*
(Continued)

*Primary Examiner* — Kyung Lee
(74) *Attorney, Agent, or Firm* — Crowell & Moring LLP

(57) ABSTRACT

Provided is a chip resistor in which cracks, fracture, etc. can be surely prevented from occurring due to thermal stress in solder bonding portions. The chip resistor 1 includes: a ceramic substrate 2 that is shaped like a cuboid; a pair of front electrodes 3 that are provided on lengthwise opposite end portions of a front surface of the ceramic substrate 2; a resistor body 4 that is provided between and connected to the two front electrodes 3; a protective layer 5 that covers the resistor body 4; a pair of back electrodes 6 that are provided on lengthwise opposite end portions of a back surface of the ceramic substrate 2; end-surface electrodes 7 through which the front electrodes 3 and the back electrodes 6 are electrically conductively connected to each other respectively; external electrodes 8 that cover the end-surface electrodes 7; and a pair of insulating resin layers 9 that are provided to cover edge portions of the back electrodes 6; wherein: the pair of insulating resin layers 9 are opposed to each other with interposition of a predetermined interval therebetween on the back surface of the ceramic substrate 2; and at least
(Continued)

opposed side end portions of the insulating resin layers 9 are exposed from the external electrodes 8.

3 Claims, 4 Drawing Sheets

(58) Field of Classification Search
USPC ..... 338/332
See application file for complete search history.

(56) References Cited

FOREIGN PATENT DOCUMENTS

| | | | |
|---|---|---|---|
| JP | 10-256001 | A | 9/1998 |
| JP | 2008-84905 | A | 4/2008 |
| JP | 2013-74044 | A | 4/2013 |
| JP | 2015-29009 | A | 2/2015 |
| JP | 2015-70166 | A | 4/2015 |

OTHER PUBLICATIONS

Iida, 2008-084905, Apr. 2008. Machine translation.*
Iida et al., JP 2000-030903, Jan. 2000. Machine translation.*
International Search Report (PCT/ISA/210) issued in PCT Application No. PCT/JP2016/061699 dated Jun. 21, 2016 with English translation (Four (4) pages).
Japanese-language Written Opinion (PCT/ISA/237) issued in PCT Application No. PCT/JP2016/061699 dated Jun. 21, 2016 (Three (3) pages).

* cited by examiner

CHIP RESISTOR

TECHNICAL FIELD

The present invention relates to a chip resistor which is surface-mounted on a circuit board by soldering.

BACKGROUND ART

This type of chip resistor is provided with a ceramic substrate, a pair of front electrodes, a resistor body, a protective layer, a pair of back electrodes, a pair of end-surface electrodes, and a pair of external electrodes. The ceramic substrate is shaped like a cuboid. The pair of front electrodes are provided on lengthwise opposite end portions of a front surface of the ceramic substrate. The resistor body is provided on the front surface of the ceramic substrate so as to be connected to the pair of front electrodes. The protective layer is provided so as to cover the resistor body. The pair of back electrodes are provided on lengthwise opposite end portions of aback surface of the ceramic substrate. The pair of end-surface electrodes are provided on opposite end surfaces of the ceramic substrate so as to cover the front electrodes and the back electrodes. The pair of external electrodes are formed by plating treatment applied to external surfaces of the end-surface electrodes.

The chip resistor configured thus is surface-mounted on a circuit board in the following manner. That is, after a soldering paste is printed on lands provided in the circuit board, the back electrodes are made to face downward and the external electrodes are placed on the lands. In this state, the soldering paste is melted and solidified to thereby surface-mount the chip resistor on the circuit board. However, fatigue, cracks, fracture, etc. are apt to occur at solder bonding portions due to thermal stress.

To solve this problem, according to the background art, a chip resistor has been proposed, as disclosed in Patent Literature 1. The chip resistor has a configuration in which each of back electrodes is formed into a two-layer structure consisting of an inner layer made of sintered silver and an outer layer made of an electrically conductive resin (resin silver), and solder bonding is applied to external electrodes covering the back electrodes each having such a two-layer structure. In the chip resistor configured thus according to the background art, the outer layers of the back electrodes making contact with solder bonding portions on lands of a circuit board are made of the electrically conductive resin. Therefore, thermal stress acting on the solder bonding portions can be relaxed in comparison with a case where each of back electrodes is made of only sintered silver.

In addition, another chip resistor has been proposed, as disclosed in Patent Literature 2. The chip resistor has a configuration in which each of back electrodes is constituted by a first electrode layer made of sintered silver and a second electrode layer made of the sintered silver and laminated on the first electrode layer at a position separate from an edge portion of the first electrode layer, and solder bonding is applied to external electrodes covering such back electrodes. In the chip resistor configured thus according to the background art, a step is formed at a portion extending from a side surface of the second electrode layer to a front surface of the first electrode layer, and a step portion corresponding to the step is also formed in each of the external electrodes. Therefore, thicknesses of solder bonding portions can be increased by the step portions so that thermal stress can be relaxed.

CITATION LIST

Patent Literature

Patent Literature 1: JP-A-2008-84905
Patent Literature 2: JP-A-2013-74044

SUMMARY OF INVENTION

Technical Problem

However, in the chip resistor described in Patent Literature 1, the solder bonding is applied to the external electrodes covering the outer layers of the back electrodes, which are made of the electrically conductive resin. For this reason, outgas is generated from resin contents of the back electrodes by heating during the solder bonding so that there is a fear that solder burst may occur or firm adhesion may deteriorate due to the outgas.

On the other hand, in the chip resistor described in Patent Literature 2, both the first electrode layer and the second electrode layer constituting each of the back electrodes are made of the sintered silver without using any electrically conductive resin material. Accordingly, disadvantages such as occurrence of solder burst due to outgas derived from a resin content can be prevented. However, since both the first electrode layer and the second electrode layer constituting the back electrode are made of the sintered silver, it is difficult to form the sintered silver with a thick film thickness like an electrically conductive resin, as well known. For this reason, a height of the step in the single second electrode layer can be set only at a very small value (not larger than 10 μm). Therefore, in order to sufficiently exert the aforementioned effect using the step, it is necessary to form a plurality of second electrode layers on the first electrode layer. This causes complication of a manufacturing process. In addition, the first electrode layer made of the sintered silver has excellent tight adhesion to the ceramic substrate. However, when stress caused by heating after the chip resistor is mounted on the circuit board is repeated, thermal stress caused by a difference in thermal expansion coefficient between the circuit board and the chip resistor acts in a direction to peel the first electrode layer from the ceramic substrate. Therefore, there is also a problem that cracks may easily occur along a boundary between an edge portion (front end-side end portion) of the first electrode layer and the ceramic substrate.

The invention has been accomplished in consideration of such actual circumstances of the background art. An object of the invention is to provide a chip resistor which can surely prevent cracks, fracture, etc. from occurring due to thermal stress in solder bonding portions.

Solution to Problem

In order to attain the aforementioned object, the invention provides a chip resistor including: a ceramic substrate that is shaped like a cuboid; a pair of front electrodes that are provided on lengthwise opposite end portions of a front surface of the ceramic substrate; a resistor body that is provided between and connected to the pair of front electrodes; a protective layer that covers the resistor body; a pair of back electrodes that are provided on lengthwise opposite end portions of a back surface of the ceramic substrate; end-surface electrodes through which the front electrodes and the back electrodes are electrically conductively connected to each other respectively; and external electrodes that cover the end-surface electrodes; wherein: a pair of insulating resin layers are formed on the back surface of the ceramic substrate with interposition of a predetermined interval therebetween so as to cover edge portions of the back electrodes; and at least opposed side end portions of the insulating resin layers are exposed from the external electrodes.

In the chip resistor configured thus, the edge portions of the pair of back electrodes provided on the lengthwise opposite end portions of the back surface of the ceramic substrate are covered with the insulating resin layers, and at least the opposed side end portions of the insulating resin layers are exposed from the external electrodes. Therefore, the insulating resin layers are not covered with solders when the chip resistor is mounted. Thus, even when the back electrodes are formed out of an electrically conductive resin, outgas derived from the resin content (the insulating resin layers or the electrically conductive resin) can escape not through the solders. Accordingly, it is possible to prevent solder burst from occurring or firm adhesion from deteriorating due to the outgas. In addition, even when thermal stress generated after the chip resistor is mounted acts in a direction to peel the back electrodes from the ceramic substrate, the edge portions of the back electrodes are covered with the insulating resin layers so that it is possible to prevent cracks from occurring along boundaries between the back electrodes and the ceramic substrate. Further, the insulating resin layers overlap with the edge portions of the back electrodes, and steps at portions extending from side surfaces of the insulating resin layers to front surfaces of the back electrodes can be used to increase thicknesses of solder bonding portions. Accordingly, it is possible to prevent cracks, fracture, etc. from occurring due to the thermal stress.

In the aforementioned configuration, it may go well as long as the end-surface electrodes are connected to at least end surfaces of the back electrodes opposite to the edge portions thereof. However, when the end-surface electrodes are also formed on regions of front surfaces of the back electrodes except the edge portions thereof to be connected to the insulating resin layers, boundary portions between the back electrodes and the insulating resin layers are covered with the end-surface electrodes, and the end-surface electrodes are covered with the external electrodes. Accordingly, the back electrodes are absent from boundary portions between the external electrodes and the insulating resin layers. As a result, even when the chip resistor is used in a corruptive atmosphere in which a large amount of sulfide gas is present, silver contained in the back electrodes does not react with the sulfide gas to generate silver sulfide. Accordingly, it is possible to prevent the back electrode from being sulfurized and hence prevent firm adhesion from deteriorating. Thus, it is possible to prevent cracks, fracture, etc. from occurring due to thermal stress in the back electrodes.

In this case, the insulating resin layers are formed like belts to extend from one widthwise end portions of the back surface of the ceramic substrate to the other widthwise end portions of the back surface of the ceramic substrate. When the end-surface electrodes are formed from the end surface sides by sputtering or coating, the insulating resin layers function as stoppers so that the end-surface electrodes excellent in linearity can be formed. Accordingly, linearity of the shape of each of the external electrodes deposited on the end-surface electrodes can be enhanced.

Advantageous Effects of Invention

According to the chip resistor in the invention, it is possible to prevent solder burst from occurring or firm adhesion from deteriorating due to outgas, and it is possible to prevent cracks from occurring along boundaries between the back electrodes and the ceramic substrate. Moreover, it is possible to surely prevent cracks or fracture from occurring due to thermal stress in the solder bonding portions.

DESCRIPTION OF EMBODIMENTS

Figure 1:
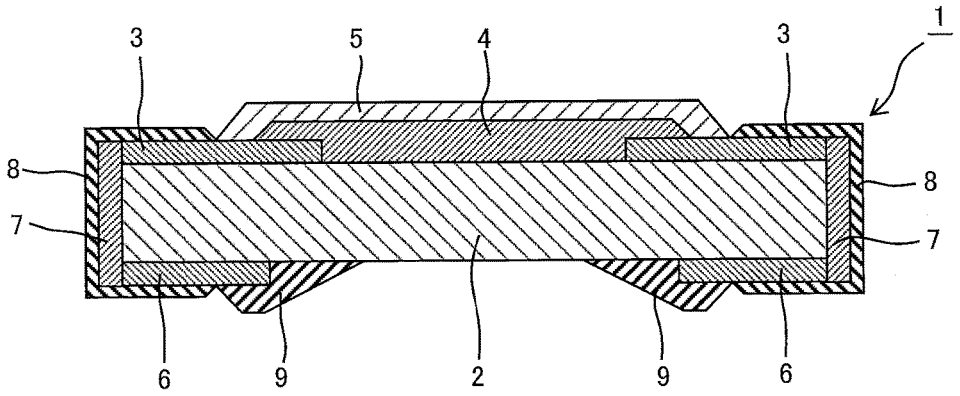
FIG. 1 A sectional view of a chip resistor according to a first embodiment of the invention.

Embodiments of the invention will be described below with reference to the drawings. As shown in FIG. 1, a chip resistor 1 according to a first embodiment of the invention is constituted by a ceramic substrate 2, a pair of front electrodes 3, a resistor body 4, a protective layer 5, a pair of back electrodes 6, a pair of end-surface electrodes 7, a pair of external electrodes 8, and a pair of insulating resin layers 9. The ceramic substrate 2 is shaped like a cuboid. The pair of front electrodes 3 are provided on lengthwise opposite end portions of a front surface of the ceramic substrate 2. The resistor body 4 is provided between and connected to the two front electrodes 3. The protective layer 5 covers the resistor body 4. The pair of back electrodes 6 are provided on lengthwise opposite end portions of a back surface of the ceramic substrate 2. Through the pair of end-surface electrodes 7, the front electrodes 3 and the back electrodes 6 are electrically conductively connected to each other respectively. The pair of external electrodes 8 are deposited on the front electrodes 3, the end-surface electrodes 7 and front surfaces of the back electrodes 6. The pair of insulating resin layers 9 cover edge portions of the back electrodes 6 exposed from the external electrodes 8.

The ceramic substrate 2 is an insulating substrate containing alumina as a main component. A large-sized substrate which will be described later is divided along primary division grooves and secondary division grooves which extend lengthwise and widthwise. Thus, a large number of such ceramic substrates 2 are obtained.

The pair of front electrodes 3 are obtained by screen-printing, drying and sintering an Ag-based paste. The resistor body 4 is obtained by screen-printing, drying and sintering a resistor paste of ruthenium oxide etc. Lengthwise opposite end portions of the resistor body 4 overlap with the front electrodes 3 respectively. Although not shown, a trimming groove is formed in the resistor body 4 in order to adjust a resistance value thereof.

The protective layer 5 is formed into a two-layer structure consisting of an undercoat layer and an overcoat layer. Of the two-layer structure, the undercoat layer is obtained by screen-printing, drying and sintering a glass paste, and the overcoat layer is obtained by screen-printing and thermally curing an epoxy resin-based paste.

The pair of back electrodes 6 are obtained by screen-printing, drying and sintering the Ag-based paste. The pair of end-surface electrodes 7 are formed out of Ni—Cr etc. sputtered on end surfaces of the ceramic substrate 2.

The pair of external electrodes 8 are formed out of Ni, Sn, or the like with which front surfaces of the end-surface electrodes 7 are electroplated. As will be described later, solder bonding is applied to the external electrodes 8 when the chip resistor 1 is mounted on a circuit board.

The pair of insulating resin layers 9 are obtained by screen-printing and thermally curing an epoxy resin paste. One end sides of the insulating resin layers 9 are opposed to each other with interposition of a predetermined interval therebetween on the back surface of the ceramic substrate 2. The other end sides of the insulating resin layers 9 overlap with the edge portions of the back electrodes 6.

Figure 2:
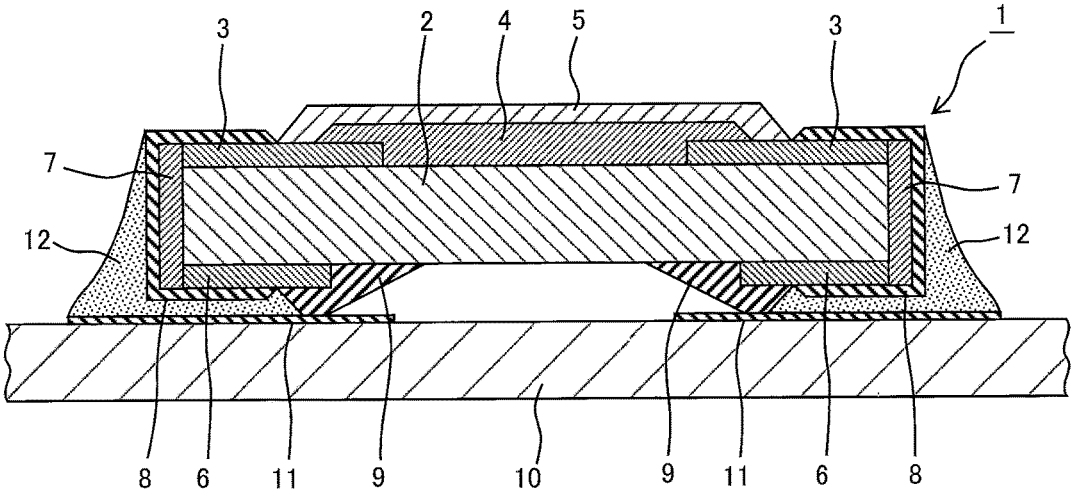
FIG. 2 A sectional view showing a state in which the chip resistor is mounted.

As shown in FIG. 2, the chip resistor 1 configured thus is placed on the circuit board 10 with the back electrodes 6 facing downward. In this state, lands 11 provided in the circuit board 10 and the external electrodes 8 are bonded to each other through solders 12 respectively. Thus, the chip resistor 1 is surface-mounted on the circuit board 10. On this occasion, the edge portions of the pair of back electrodes 6 are covered with the insulating resin layers 9 respectively. The insulating resin layers 9 are continuous to the external electrodes 8 in outer side positions than the edge portions of the back electrodes 6. Therefore, at least the opposed end sides of the pair of insulating resin layers 9 are not covered with the solders 12 but exposed when the chip resistor 1 is mounted. Thus, even when outgas is generated from the insulating resin layers 9 by heating during the solder bonding, the outgas escapes to the outside from the regions which are not covered with the solders 12. Therefore, it is possible to prevent solder burst from occurring or firm adhesion from deteriorating due to the outgas.

In addition, even when force acts in a direction to peel the back electrodes 6 from the back surface of the ceramic substrate 2 due to thermal stress during mounting of the chip resistor 1, the edge portions of the back electrodes 6 are covered with the insulating resin layers 9 to be prevented from being separated easily. Therefore, no cracks occur along boundaries between the back electrodes 6 and the ceramic substrate 2. Further, the insulating resin layers 9 overlap with the front surfaces of the edge portions of the back electrodes 6. Steps at portions extending from side surfaces of the insulating resin layers 9 to the front surfaces of the back electrodes 6 can be used to increase thicknesses of the solders 12. Therefore, it is possible to prevent cracks, fracture, etc. from occurring due to thermal stress.

Next, a manufacturing method for the chip resistor 1 configured as described above will be described with reference to FIG. 3 and FIG. 4.

Figure 3:
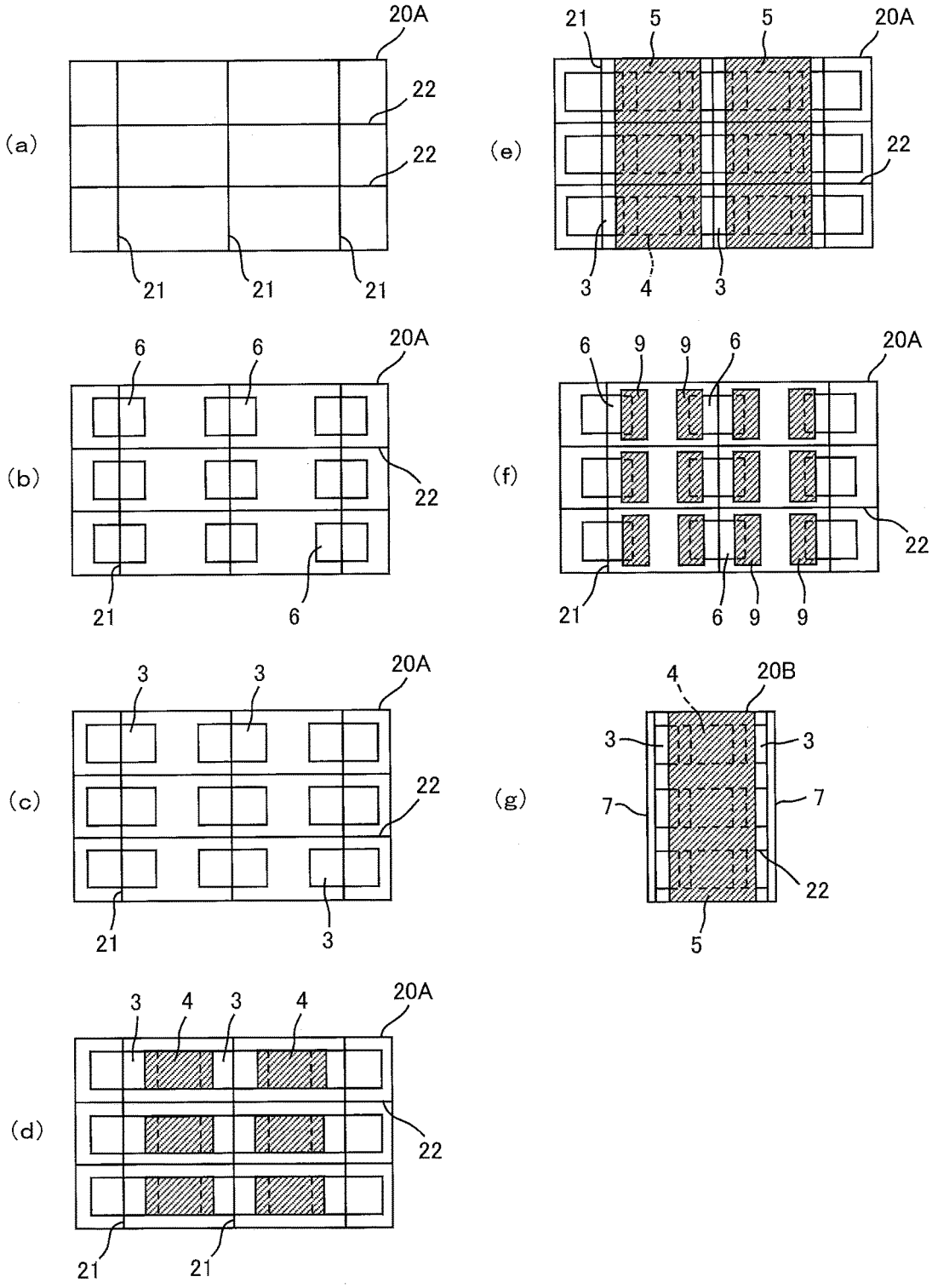
FIG. 3 Explanatory views showing a manufacturing process of the chip resistor.
Figure 4:
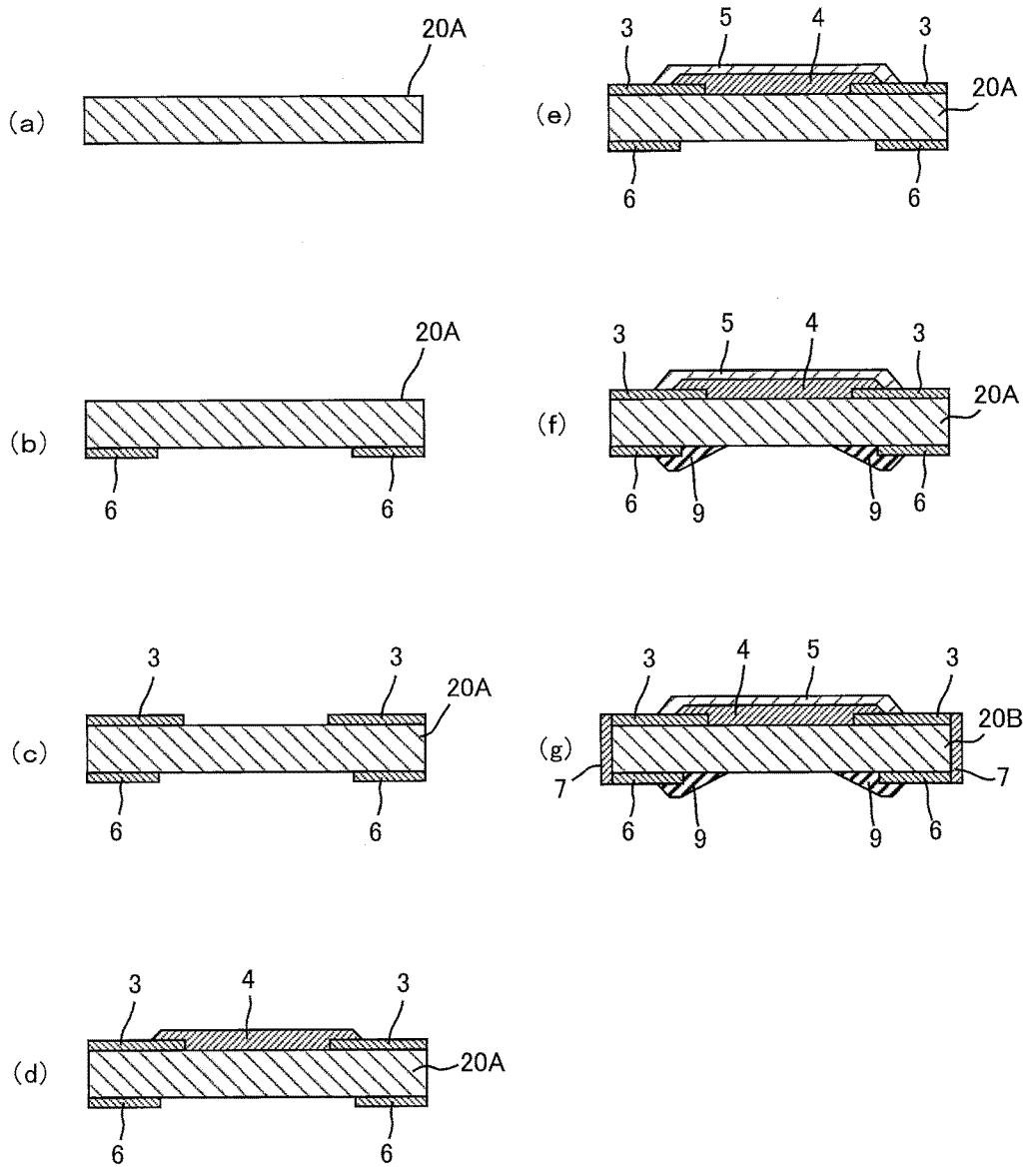
FIG. 4 Explanatory views showing the manufacturing process of the chip resistor.

First, as shown in FIG. 3(*a*) and FIG. 4(*a*), a large-sized substrate 20A from which a large number of ceramic substrates 2 can be obtained is prepared. Primary division grooves 21 and secondary division grooves 22 are provided in a grid pattern in two surfaces, i.e. a front surface and a back surface of the large-sized substrate 20A in advance. Each of cells partitioned by the two division grooves 21 and 22 serves as a chip formation region in which one chip resistor can be formed. Incidentally, a plurality of such chip formation regions are representatively shown in FIG. 3, and sectional views corresponding to such a chip region are shown in FIG. 4. However, in practice, each step which will be described below is performed collectively on the large-sized substrate 20A corresponding to a large number of such chip formation regions.

That is, an Ag paste screen-printed on the back surface of the large-sized substrate 20A is dried. Thus, as shown in FIG. 3(*b*) and FIG. 4(*b*), a plurality of unsintered back electrodes 6 are formed so as to be laid across the primary division grooves 21 respectively. Next, the Ag paste screen-printed on the front surface of the large-sized substrate 20A is dried. Thus, as shown in FIG. 3(*c*) and FIG. 4(*c*), a plurality of unsintered front electrodes 3 are formed so as to be laid across the primary division grooves 21 respectively. Then, the unsintered front electrodes 3 and the unsintered back electrodes 6 are sintered simultaneously. Thus, the back electrodes 6 made of the sintered silver are formed on the back surface of the large-sized substrate 20A, and the front electrodes 3 made of the sintered silver are formed on the front surface of the large-sized substrate 20A. Incidentally, a sequence of forming the front electrodes 3 and the back electrodes 6 may be reversed to the aforementioned sequence. That is, the back electrodes 6 may be formed after the front electrodes 3 are formed.

Next, a resistor paste of ruthenium oxide or the like screen-printed on the front surface of the large-sized substrate 20A is dried and sintered. Thus, as shown in FIG. 3(*d*) and FIG. 4(*d*), a resistor body 4 is formed on a central portion of each of the chip regions. On this occasion, lengthwise opposite end portions of the resistor body 4 are superimposed on the front electrodes 3 provided on lengthwise opposite end portions of the chip region.

Next, as a material for reducing damage on the resistor bodies 4 during formation of trimming grooves, a glass paste is screen-printed, dried and sintered. Thus, an undercoat layer covering the resistor bodies 4 is formed. Then, the trimming grooves are formed in the resistor bodies 4 from above the undercoat layer to thereby adjust resistance values of the resistor bodies 4. Thereafter, a resin paste such as an epoxy resin-based paste screen-printed on the undercoat layer is thermally cured so that an overcoat layer covering the undercoat layer can be formed. Thus, as shown in FIG. 3(*e*) and FIG. 4(*e*), protective layers 5 each having the two-layer structure are formed to cover the resistor bodies 4.

Incidentally, the back electrodes 6 may be formed out of resin silver in place of the sintered silver. In this case, sintering temperature of the resistor paste is considerably higher than melting temperature of the resin silver. Therefore, the back electrodes 6 may be formed out of the resin silver after the resistor bodies 4 and the protective layers 5 are formed. In addition, when the chip resistor 1 in which the back electrodes 6 are formed out of the resin silver in this manner is mounted, outgas is generated also from the resin contained in the back electrodes 6 by heating during solder bonding. However, the outgas can escape not through solders but through insulating resin layers 9 covering edge portions of the back electrodes 6. Accordingly, it is possible to prevent solder burst from occurring or firm adhesion from deteriorating due to the outgas even when the back electrodes 6 are formed out of the resin silver.

Next, an epoxy resin paste screen-printed on the back surface of the large-sized substrate 20A is thermally cured. Thus, as shown in FIG. 3(*f*) and FIG. 4(*f*), the insulating resin layers 9 covering the edge portions of the back electrodes 6 opposed to each other in each of the chip regions are formed.

The steps so far are processed in batch on the large-sized substrate 20A. Next, after the large-sized substrate 20A is broken (primarily divided) along the primary division grooves 21 into strip-shaped substrates 20B, Ni—Cr is sputtered on divided surfaces of the strip-shaped substrates 20B. Thus, as shown in FIG. 3(*g*) and FIG. 4(*g*), end-surface electrodes 7 through which the front electrodes 3 and the back electrodes 6 are electrically conductively connected to each other respectively are formed on the opposite end surfaces of the strip-shaped substrates 20B.

Then, the strip-shaped substrates 20B are broken (secondarily divided) along the secondary division grooves 22. Thus, single chips (individual pieces) equal in size to the chip resistor 1 are obtained. Then, the single chips which have been divided separately and individually are electroplated with Ni, Sn, or the like. Thus, external electrodes 8 are formed to be deposited on the exposed front electrodes 3, the exposed end-surface electrodes 7, and front surfaces of the exposed back electrodes 6. As a result, chip resistors 1 shown in FIG. 1 are completed.

Figure 5:
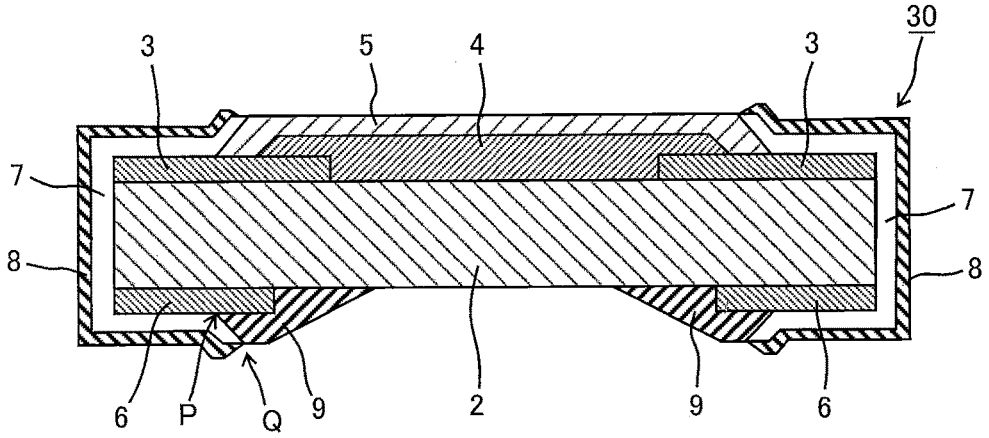
FIG. 5 A sectional view of a chip resistor according to a second embodiment of the invention.
Figure 6:
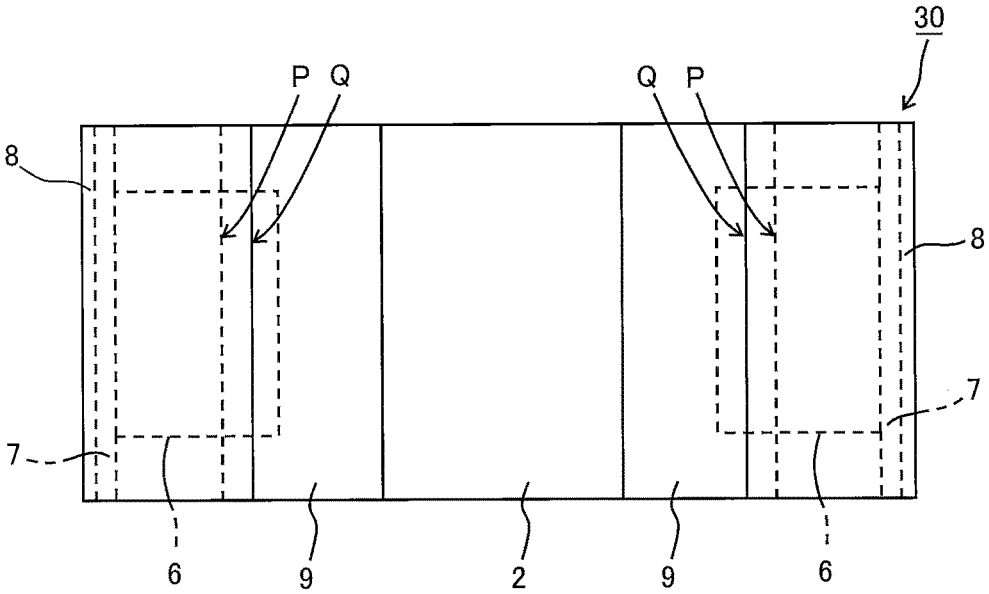
FIG. 6 A back view of the chip resistor.

FIG. 5 is a sectional view of a chip resistor 30 according to a second embodiment of the invention. FIG. 6 is aback view of the chip resistor 30. In FIG. 5 and FIG. 6, portions corresponding to those in FIG. 1 are referred to by the same signs respectively.

The chip resistor 30 according to the second embodiment is different from the chip resistor 1 according to the first embodiment at a point that each of insulating resin layers 9 is formed like a belt to extend from one widthwise end portion of aback surface of a ceramic substrate 2 to the other widthwise end portion of the back surface of the ceramic substrate 2 (from an upper side to a lower side in FIG. 6), and each of end-surface electrodes 7 is formed into a U-shape in section to extend from an upper surface of a corresponding front electrode 3 to a lower surface of a corresponding back electrode 6. As for the remaining configuration, the chip resistor 30 according to the second embodiment is basically the same as the chip resistor 1 according to the first embodiment.

That is, as shown in FIG. 5 and FIG. 6, the remaining regions of the back electrodes 6 except edge portions thereof covered with the insulating resin layers 9 are covered with the end-surface electrodes 7, and external electrodes 8 are deposited on front surfaces of the end-surface electrodes 7. Accordingly, boundary portions (see portions P in FIG. 5 and FIG. 6) between the back electrodes 6 and the insulating resin layers 9 are covered with the end-surface electrodes 7, and the back electrodes 6 are positioned at inner portions separate from boundary portions (portions Q in FIG. 5 and FIG. 6) between the external electrodes 8 and the insulating resin layers 9. In addition, the insulating resin layers 9 covering the edge portions of the back electrodes 6 are formed to extend from ends to ends of side faces of the ceramic substrate 2. When sputtering is performed from the end-surface sides to form the end-surface electrodes 7 out of Ni—Cr containing 20% or more of Cr or the like that can be extended around easily, or when an Ag paste or the like is dip-coated to form the end-surface electrodes 7, the insulating resin layers 9 formed like jetties function as stoppers so that the end-surface electrodes 7 excellent in linearity can be formed on the back surface of the ceramic substrate 2.

Also in the chip resistor 30 configured thus, the edge portions of a pair of the back electrodes 6 are covered with the insulating resin layers 9 respectively in the same manner as in the chip resistor 1 according to the first embodiment. Accordingly, it is possible to prevent solder burst from occurring or firm adhesion from deteriorating due to outgas, and it is possible to prevent cracks from occurring along boundaries between the back electrodes 6 and the ceramic substrate 2. In addition, steps at portions extending from side surfaces of the insulating resin layers 9 to front surfaces of the back electrodes 6 can be used to increase thicknesses of solder bonding portions. Accordingly, it is possible to prevent cracks, fracture, etc. from occurring due to thermal stress.

Further, in the chip resistor 30 according to the second embodiment, the end-surface electrodes 7 are also formed on the regions of the back electrodes 6 except the edge portions thereof to be connected to the insulating resin layers 9. The boundary portions P between the back electrodes 6 and the insulating resin layers 9 are covered with the end-surface electrodes 7 entirely. Therefore, when the chip resistor 30 is used in a corruptive atmosphere in which a large amount of sulfide gas is present, silver (Ag) contained in the back electrodes 6 do not react with the sulfide gas to generate silver sulfide. Thus, it is possible to prevent the back electrodes 6 from being sulfurized. In addition, each of the insulating resin layers 9 is formed like a belt to extend one widthwise end portion of the back surface of the ceramic substrate 2 to the other widthwise end portion of the back surface of the ceramic substrate 2. When the end-surface electrodes 7 are formed by sputtering or coating, the insulating resin layers 9 function as stoppers so that the end-surface electrodes 7 excellent in linearity can be formed. Accordingly, linearity of the shape of each of the external electrodes 8 deposited on the end-surface electrodes 7 can be enhanced. As a result, as shown in FIG. 6, the rectangular external electrodes 8 can be formed on lengthwise opposite end portions of the back surface of the ceramic substrate 2. Since solder bonding is applied to the external electrodes 8, a self-alignment property during the solder bonding can be improved.

Incidentally, when a pair of insulating resin layers 9 isolated from each other with interposition of a predetermined interval therebetween are formed by screen-printing a resin paste in the case of a chip resistor small in external size, the two insulating resin layers 9 maybe connected to each other due to printing sagging. Even in such a case, functions and effects of the invention can be still obtained.

REFERENCE SIGNS LIST

1, 30 chip resistor
2 ceramic substrate
3 front electrode
4 resistor body
5 protective layer
6 back electrode
7 end-surface electrode 7
8 external electrode
9 insulating resin layer
10 circuit board
11 land
12 solder
20A large-sized substrate
20B strip-shaped substrate
21 primary division groove
22 secondary division groove

The invention claimed is:

1. A chip resistor comprising: a ceramic substrate that is shaped like a cuboid; a pair of front electrodes that are provided on lengthwise opposite end portions of a front surface of the ceramic substrate; a resistor body that is provided between and connected to the pair of front electrodes; a protective layer that covers the resistor body; a pair of back electrodes that are provided on lengthwise opposite end portions of a back surface of the ceramic substrate; end-surface electrodes through which the front electrodes and the back electrodes are electrically conductively connected to each other respectively; and external electrodes that cover the end-surface electrodes; wherein:

a pair of insulating resin layers are formed on the back surface of the ceramic substrate with interposition of a predetermined interval therebetween so as to cover edge portions of the back electrodes; and at least opposed side end portions of the insulating resin layers are exposed from the external electrodes.

2. A chip resistor according to claim 1, wherein: the end-surface electrodes are formed on regions of the back electrodes except the edge portions thereof so as to be connected to the insulating resin layers.

3. resistor according to claim 2, wherein: the insulating resin layers are formed like belts to extend from one widthwise end portions of the back surface of the ceramic substrate to the other widthwise end portions of the back surface of the ceramic substrate.

* * * * *